United States Patent [19]

Nakagawa et al.

[11] 4,317,335

[45] Mar. 2, 1982

[54] REFRIGERATING APPARATUS

[75] Inventors: Noboru Nakagawa, Osaka; Toshiyuki Oonishi, Takatsuki; Masato Tsutsumi, Osaka; Akira Kawamoto, Takatsuki, all of Japan

[73] Assignee: Tokyo Shibaura Denki Kabushiki Kaisha, Kanagawa, Japan

[21] Appl. No.: 152,983

[22] Filed: May 27, 1980

[30] Foreign Application Priority Data

Aug. 8, 1979 [JP] Japan ..... 54-101091

[51] Int. Cl.[3] ..... F25B 9/00

[52] U.S. Cl. ..... 62/199; 62/504; 62/525

[58] Field of Search ..... 62/197, 198, 199, 200, 62/504, 525

[56] References Cited

U.S. PATENT DOCUMENTS

| | | | |
|---|---|---|---|
| 2,115,769 | 5/1938 | Harris | 165/179 |
| 2,697,331 | 12/1954 | Zearfoss, Jr. | 62/198 |
| 2,791,101 | 5/1957 | Zearfoss, Jr. | 62/198 |
| 3,826,304 | 7/1974 | Withers, Jr. et al. | 165/179 |
| 3,950,961 | 4/1976 | Lotz | 62/198 |
| 4,019,337 | 4/1977 | Zearfoss, Jr. | 62/197 |
| 4,130,997 | 12/1978 | Hara et al. | 62/504 |

*Primary Examiner*—Ronald C. Capossela

*Attorney, Agent, or Firm*—Cushman, Darby & Cushman

[57] ABSTRACT

A refrigerating apparatus comprising at least two evaporators which are controlled at different temperatures by a refrigerant, conduits for conducting the refrigerant to the evaporators, a rising portion which is formed in one of the conduits and which has an irregularly formed inner surface, a heater winding around the outer surface of not only the irregularly formed portion but also the portion of the conduit above the irregularly formed portion in order to produce smoother, more effective bubbling action.

5 Claims, 8 Drawing Figures

REFRIGERATING APPARATUS

This invention relates to a refrigerating apparatus, more particularly to an improvement in a refrigerating apparatus in which at least two evaporators are controlled to a different temperature.

Generally, a refrigerator having a freezing compartment and refrigerating compartment which are controlled to a different temperature has separate evaporators for the freezing compartment and for the refrigerating compartment because separate cooling is necessary for each compartment. The temperature of the compartment is controlled by a solenoid valve which is located in a conduit path connecting the freezing evaporator and the refrigerating evaporator for controlling refrigerant flow to one or both of the evaporators.

However, such solenoid valve has a mechanically movable valve which is buried in a heat insulating material so that it is difficult to maintain or inspect the valve after the refrigerator is assembled. Accordingly, the life and the reliability of the refrigerator are not sufficient, and, moreover, this structure is too expensive.

Recently, a refrigerator which has a vapor bubble pump providing valve action to the refrigerant has been developed. However, this refrigerator has the drawback that the refrigerant flows into a auxiliary evaporator.

It is an object of this invention to provide a refrigerating apparatus which has a vapor bubble pump for pumping the refrigerant by a heater.

It is another object of the invention to provide a refrigerating apparatus which can change the flow of refrigerant by a vapor bubble pump.

It is a further object of the invention to provide a refrigerating apparatus which can avoid the leakage of refrigerant flow into a auxiliary evaporator.

It is still a further object of the invention to provide a refrigerating apparatus in which the efficiency of the vapor bubble pump is improved.

In this invention at least two evaporators are connected by conduits through which flows a refrigerant, with a rising portion formed in one of the conduits. The inner surface of the rising portion is irregularly formed and about the outer surface, not only the irregularly formed portion but also above that portion, is wound a heater which causes vapor bubble pumping action to the refrigerant in the rising portion. Extending the heater about the upper portion produces smoother, more effective bubbling action. Further, the refrigerant is controlled to flow into each evaporator.

The foregoing objects and other objects as well as the characteristic features of the invention will become more apparant and more readily understood by the following description and the appended claims when read in conjunction with the accompanying drawings.

FIG. 2 shows that the vapor bubble pump not in operation, FIG. 3 shows that the vapor bubble pump in operation.

Figure 1:
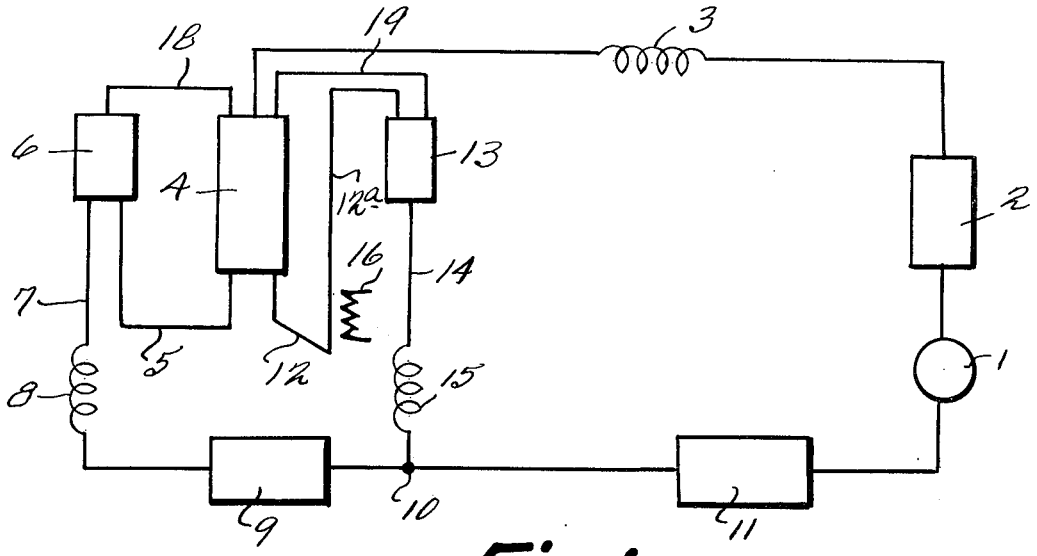
FIG. 1 is a schematic view of a refrigerating cycle of this invention.

Referring to FIG. 1, high temperature gas of a refrigerant which is compressed by a compressor 1 is condensed by a condenser 2 and suppied to a liquid tank 4 through a pressure regulator such as a capillary tube 3. One end of a U-shaped conduit 5 is located in tank 4 and extends through the bottom of tank 4. The other end of conduit 5 is connected to the bottom opening of an accumulator or reservoir 6. One end of a conduit 7 is located in accumulator 6 and extends through the bottom thereof. Conduit 7 is connected to a refrigerator evaporator 9 through a pressure regulator such as a capillary tube 8. Refrigerator evaporator 9 is connected to a freezer evaporator 11 by a connecting conduit 10, and freezer evaporator 11 is connected to compressor 1 to form a closed refrigerating cycle.

Figure 4:
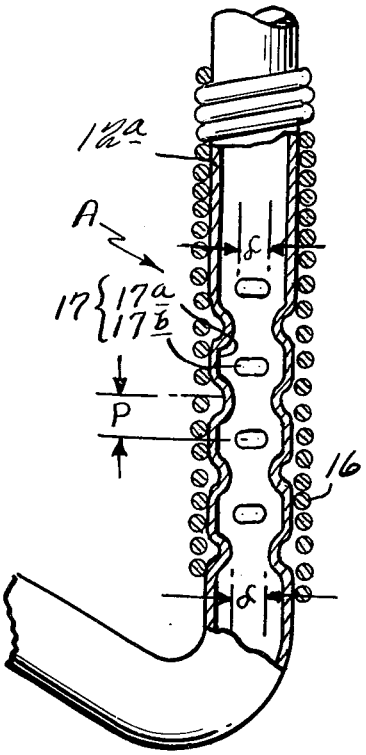
FIG. 4 is an enlarged view, partly in section, of the vapor bubble pump of the invention.

One end of another U-shaped conduit 12 is connected to the bottom opening of tank 4 and the other end of conduit 12 is connected to an opening in the top of a joint box 13 by bending downwardly. A rising portion 12*a* of conduit 12 extends higher than the top of conduit 7 which is connected to accumulator 6. One end of a conduit 14 is connected to the bottom opening of joint box 13 and the other end of conduit 14 is connected to connecting conduit 10 through a pressure regulator such as a capillary tube 15. As shown in FIG. 4, the inner surface of rising portion 12*a* is irregularly formed in alternate concave surfaces 17*a* and convex surfaces 17*b*. A heater 16 is wound around the outer surface of a irregularly formed portion 17 of rising portion 12*a* and is also wound around the outer surface of the portion of conduit 12 which is above irregularly formed portion 17 of rising portion 12*a*. Rising portion 12*a*, concave portion 17*a*, convex portion 17*b* and heater 16 form a vapor bubble pump A. The inner pressure of tank 4, accumulator 6 and joint box 13 are equalized by conduits 18 and 19 which are connected between tank 4 and accumulator 6 and between tank 4 and joint box 13 respectively.

Figure 5:
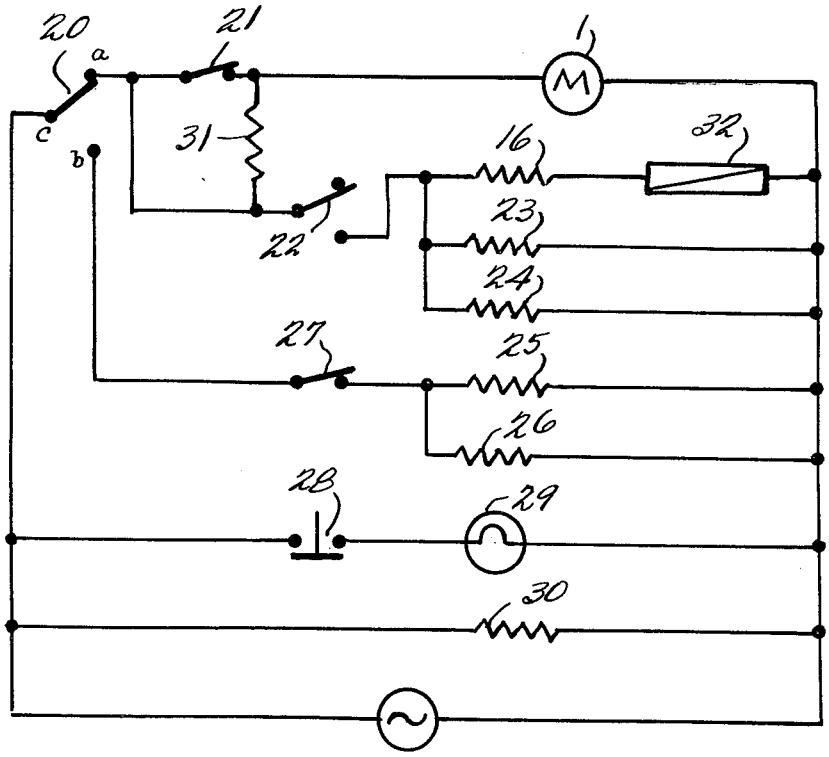
FIG. 5 is a wiring diagram of the invention.
Figure 2:
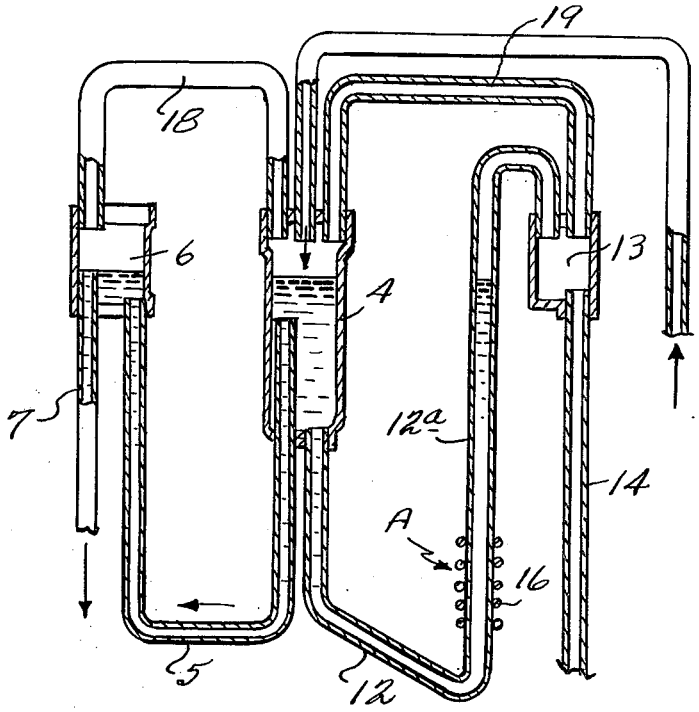
FIG. 2 and FIG. 3 are a construction of a vapor bubble pump of the invention.

FIG. 5 is a wiring diagram of this invention. The motor of compressor 1 is driven when the contact (a-c) of a defrost switch 20 is closed and a control switch 21 of the freezing compartment is closed. Heater 16 of vapor bubble pump A, a connect pipe heater 23 and a drain gutter heater 24 are energized when the temperature of the refrigerating compartment falls below a predetermined value and a control switch 22 of the refrigerating compartment is turned on. The motor of compressor 1 is stopped when the freezing compartment is cooled to a predetermined temperature and control switch 21 of freezing compartment is turned off. The defrosting cycle, which is conventional, is attained by energizing a defrost heater 25 and a defrost sensor heater 26. A defrost bimetal switch 27 opens when the defrosting cycle is finished. A door switch 28 is closed when the door of the refrigerating compartment is opened and a lamp 29 which is located in the refrigerating compartment is turned on. A drain pipe heater 30 is located near the drain pipe of the freezing compartment, a heater 31 heats freezer control switch 21 and a fuse 32 is located in series with heater 16 of vapor bubble pump A.

The operation of the invention will now be explained according to FIG. 5. When the temperature of the refrigerating compartment and the freezing compartment is higher than a predetermined value, control switch 21 of the freezing compartment is kept closed and control switch 22 of the refrigerating compartment is kept open. Then the motor of compressor 1 is driven while heater 16 is kept deenergized. The refrigerant which is compressed by compressor 1 and condensed by condenser 2 is stored in liquid tank 4. The liquid refrigerant flows into accumulator 6 through U-shaped conduit 5 when the liquid level in tank 4 rises higher than the top of U-shaped conduit 5 in tank 4. The liquid refrigerant goes to refrigerator evaporator 9 and the freezer evaporator 11 through conduit 7 and capillary tube 8 so that the refrigerating compartment and the freezing compartment are cooled. In this condition, the liquid refrigerant does not flow into conduit 14 through U-shaped conduit 12 and joint box 13 because the inner pressure of tank 4, accumulator 6 and joint box 13 are kept equal by conduits 18 and 19 as the liquid level in tank 4, accumulator 6 and U-shaped conduit 12 are kept equal, and because rising portion 12*a* extends higher than the top of conduit 7.

Figure 3:
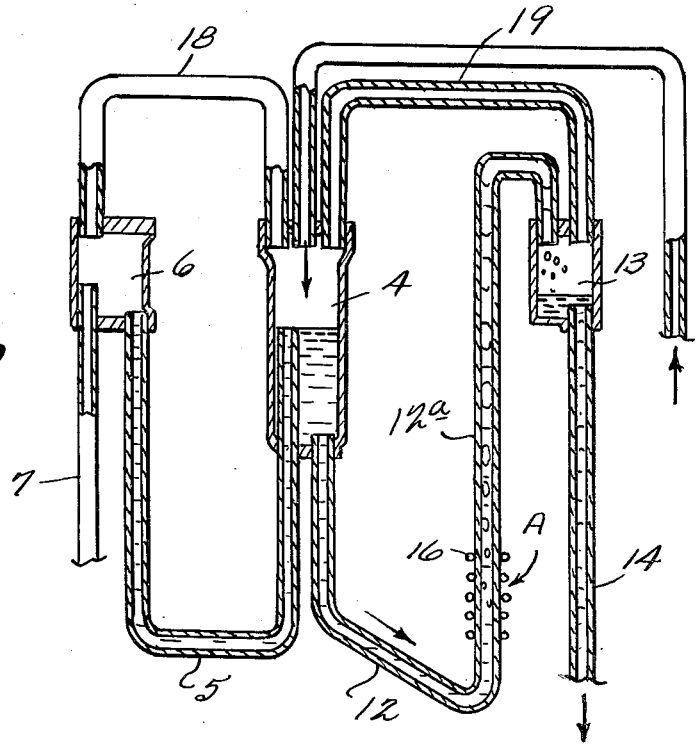

Heater 16 is energized when control switch 22 turns on so to that the refrigerator compartment is cooled at the predetermined temperature. Vapor bubbles of liquid refrigerant in rising portion 12*a* as produced by heating rising portion 12*a* with heater 16. The liquid refrigerant is pumped up by the bubbles and overflows from the top of rising portion 12*a* into joint box 13 (see FIG. 3). Then, the liquid refrigerant flows into freezer evaporator 11 through conduit 14 and capillary tube 15, and cools the freezing compartment. At this time, the liquid level in tank 4 is reduced as the liquid refrigerant flows into freezing evaporator 11 through joint box 13. The cooling of refrigerating compartment is interrupted when the flow of liquid refrigerant into refrigerator evaporator 10 is stopped. Since the temperature of the refrigerator compartment is lower than the predetermined temperature, compressor 1 is controlled in order to increase and decrease the temperature of the freezing compartment. When the temperature of the refrigerating compartment increases above the predetermined temperature, the action of vapor bubble pump A stops because control switch 22 is turned off. The liquid refrigerant then flows through both the refrigerating and the freezing compartment via accumulator 6.

Heater 16 is wound around the outer surface of irregularly formed portion 17 and about the portion above irregularly formed portion 17, so that the bubbles are produced relatively quickly at irregularly formed portion 17. The bubble produced at the portion above irregularly formed portion are produced smoothly and the resistance against the flow of the liquid refrigerant in that upper portion is small because the inner surface of the portion is flat. Thus the bubbles which are produced at the irregularly formed portions can go up smoothly and the pumping efficiency for pushing up the refrigerant is improved, so that the leakage of the refrigerant flow into refrigerator evaporator 9 through accumulator 6 is avoided.

Figure 6:
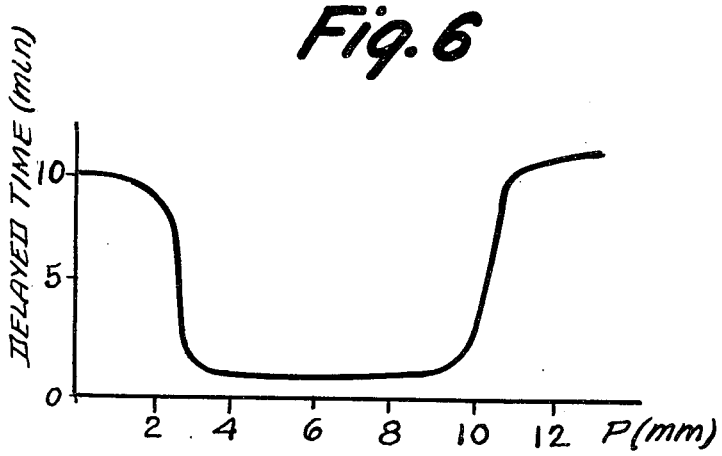
FIG. 6 is a diagram between delayed time of a bubbling action and a longitudinal distance of the closest two inner convexes of a conduit of the vapor bubble pump of the invention.

FIG. 6 is a diagram between the time which is necessary to produce the bubbles after a 5 watt heater 16 of vapor bubble pump A is turned on and the longitudinal distance P of the closest two inner convex surfaces 17*b* of irregularly formed portion 17. The time until the bubble is produced, namely the delay time which is necessary to produce the bubbles after heater 16 is turned on is short when distance P is between 3 mm to 10 mm.

Figure 7:
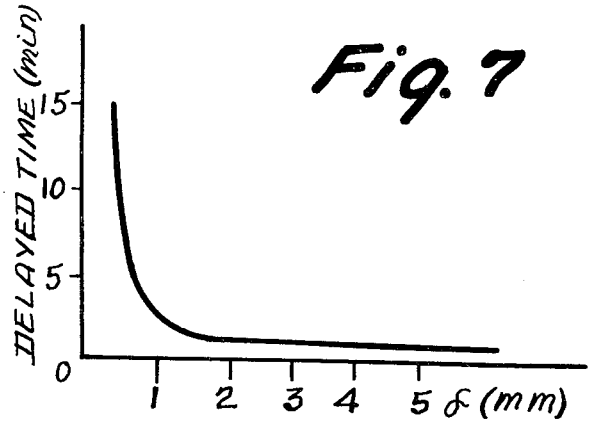
FIG. 7 is a diagram between delayed time of the bubbling action and a horizontal distance of the inner closest two diametral convex of the conduit of the vapor bubble pump of the invention.

FIG. 7 is a diagram between the time which is necessary to produce the bubbles after 5 watt heater 16 is turned on and the horizontal distance between opposing inner convex surfaces 17*b* when the irregularlity of the inner surface is more than 0.5 mm. The time until the bubble is produced is short when distance is larger than 1 mm. If distance is smaller than 1 mm, the effect of the irregularity is very small.

Figure 8:
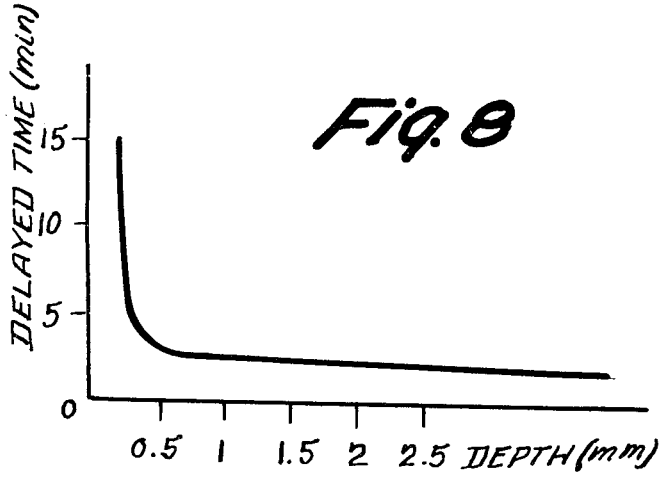
FIG. 8 is a diagram between delay time of the bubbling action and the depth of the concave of the inner surface of the conduit.

FIG. 8 is a diagram between the time which is necessary to produce the bubble after 5 watt heater 16 is turned on and the depth of concave surface 17*a*. The time until the bubble is produced is short when the depth of concave 17*a* is more than 0.5 mm. As a result of a experiment, the bubbles are produced 1 minute after heater 16 is turned on when the depth is 1.25 mm and is 2.1 mm.

In the above described embodiment, the refrigerant flows only to freezer evaporator 11 when vapor bubble pump A is acting, but it may be possible to flow the refrigerant to both freezer evaporator 11 and refrigerator evaporator 9 when vapor bubble pump A is acting.

What is claimed is:

1. Refrigerating apparatus comprising:

a compressor for compressing a refrigerant, at least two evaporators which are controlled to a different temperature by evaporation of said refrigerant, a tank for storing said refrigerant, a plurality of conduits for conducting said refrigerant to said compressor, said evaporators and said tank, a rising portion which is formed by one of said conduits connecting said tank to one of said evaporators and of which the inner surface is irregularly formed, and a heater winding around the outer surface of the irregularly formed portion and around the portion above said irregularly formed portion of said rising portion, thereby causing a smooth vapor bubble pumping action and supplying said refrigerant to a part of said one evaporator.

2. Apparatus as in claim 1 wherein said irregularly formed surfaces has alternate convex and concave surfaces and the longitudinal distance between adjacent convex surfaces of said irregularly formed surface is from 3 mm to 10 mm.

3. Apparatus as in claims 1 or 2 wherein said irregularly formed surface has alternative convex and concave surfaces and the horizontal distance between inner closest opposing convex surface of said irregularly formed portion is larger than 1 mm.

4. Apparatus as in claims 1 or 2 wherein said irregularly formed surface has alternate convex and concave surfaces and the depth of said inner concave surface of said irregularly formed portion is larger than 0.5 mm.

5. Apparatus as in claims 1 or 2 wherein one of said evaporators is for a refrigerator and the other one of said evaporators is for a freezer.

* * * * *